US011731745B1

(12) United States Patent
Abaygar et al.

(10) Patent No.: US 11,731,745 B1
(45) Date of Patent: Aug. 22, 2023

(54) PERSONAL FLOTATION, EVACUATION AND RESCUE DEVICE

(71) Applicants: Alejandre Alova Abaygar, Westminster, CA (US); Arthur James A. Abaygar, Parañaque (PH); Anne Christine A. Abaygar-Cruz, Harrisdale (AU)

(72) Inventors: Alejandre Alova Abaygar, Westminster, CA (US); Arthur James A. Abaygar, Parañaque (PH); Anne Christine A. Abaygar-Cruz, Harrisdale (AU)

( * ) Notice: Subject to any disclaimer, the term of this patent is extended or adjusted under 35 U.S.C. 154(b) by 29 days.

(21) Appl. No.: 17/206,009

(22) Filed: Mar. 18, 2021

Related U.S. Application Data

(60) Provisional application No. 62/991,116, filed on Mar. 18, 2020.

(51) Int. Cl.
*B63C 9/20* (2006.01)
*B63C 9/125* (2006.01)

(52) U.S. Cl.
CPC ..... *B63C 9/1255* (2013.01); *B63C 9/20* (2013.01)

(58) Field of Classification Search
CPC ..... B63C 9/1255; B63C 9/20
See application file for complete search history.

(56) References Cited

U.S. PATENT DOCUMENTS 2,782,430 A * 2/1957 Radnofsky ..... B63C 9/1055 441/104
4,017,908 A 4/1977 Mumane
4,017,926 A * 4/1977 Piel ..... B63C 9/1055 441/104
4,722,710 A 2/1988 Hagen et al.
5,382,184 A * 1/1995 DiForte, Jr. ..... B63C 9/135 D21/805
5,736,954 A 4/1998 Veazey
5,893,786 A 4/1999 Stevens
(Continued)

FOREIGN PATENT DOCUMENTS

GB 2082979 3/1982
GB 2082979 A * 3/1982 ..... A41D 13/0125
(Continued)

*Primary Examiner* — S. Joseph Morano
*Assistant Examiner* — Jovon E Hayes
(74) *Attorney, Agent, or Firm* — The Patent Professor, P.A.; John Rizvi

(57) ABSTRACT

A personal flotation, rescue, and evacuation device includes a vest worn overhead by a user. The user's head fits through a central opening formed in the vest. The vest includes a front chest portion and a rear back portion. A lateral sleeve is disposed at a lower end of the rear vest portion. A buoyant structure having a pair of free ends fits through the sleeve. The free ends of the buoyant structure are wrapped around the user's waist and connected in front to form a waist belt flotation structure. The vest incorporates a hood having a frame component at its front edge. When deployed, the hood remains in an erect, lofted condition and creates a canopy effect surrounding the user's head. The hood is connected at its lower end to another flotation element arranged in a collar configuration. This collar-type flotation element is connected in front to the waist belt flotation structure.

18 Claims, 14 Drawing Sheets

(56) References Cited

U.S. PATENT DOCUMENTS

| | | | | |
|---|---|---|---|---|
| 6,203,390 | B1 | 3/2001 | Elliott | |
| 6,368,174 | B1 | 4/2002 | Magee | |
| 6,712,658 | B1 * | 3/2004 | Crossley | A41D 13/0125 441/106 |
| 6,749,473 | B1 | 6/2004 | Lower | |
| 6,805,519 | B1 | 10/2004 | Courtney | |
| 7,083,487 | B2 | 8/2006 | Weinel | |
| 7,641,529 | B2 | 1/2010 | Deville et al. | |
| 7,798,879 | B2 | 9/2010 | James et al. | |
| RE42,238 | E * | 3/2011 | Courtney | B63C 11/2245 441/89 |
| 8,147,286 | B2 | 4/2012 | Messina | |
| 8,251,763 | B1 | 8/2012 | Rositas | |
| 8,357,020 | B2 * | 1/2013 | Hansbro | B63C 9/115 441/106 |
| 8,662,949 | B2 * | 3/2014 | McKinney | B63C 9/20 362/108 |
| 9,381,982 | B1 * | 7/2016 | Sumpter | G01S 19/17 |
| 9,926,055 | B2 | 3/2018 | Sylvester | |
| 9,981,725 | B1 * | 5/2018 | Brown | B63C 9/20 |
| 10,259,547 | B1 * | 4/2019 | Kiel | B63C 9/20 |
| 10,286,987 | B2 | 5/2019 | Duff | |
| 2004/0157514 | A1 | 8/2004 | Courtney | |
| 2017/0043850 | A1 * | 2/2017 | MacDougall | B63C 9/26 |
| 2019/0009869 | A1 | 1/2019 | McLaughlin | |
| 2019/0061889 | A1 * | 2/2019 | Cardi | B63C 9/1255 |
| 2020/0023929 | A1 * | 1/2020 | Ngo | B63C 9/11 |

FOREIGN PATENT DOCUMENTS

| | | |
|---|---|---|
| KR | 20130003934 | 7/2013 |
| KR | 20170116621 | 10/2017 |

* cited by examiner

PERSONAL FLOTATION, EVACUATION AND RESCUE DEVICE

CROSS-REFERENCE TO RELATED APPLICATIONS

This application claims the benefit of U.S. Provisional Patent Application Ser. No. 62/991,116, filed on Mar. 18, 2020, which is incorporated herein in its entirety.

FIELD OF THE INVENTION

The present invention relates generally to life preservers, and more particularly, to a personal flotation, evacuation and/or rescue device incorporating a set of buoyant structures worn at various locations to promote multiple, independent points of buoyancy, such as at the waist, head and neck area, and crotch region.

BACKGROUND OF THE INVENTION

When referring to vacation locations whose purpose is sole relaxation rather than exploration, many individuals point to beachside resorts or pools. Unsurprisingly, the feeling of weightlessness provided by the water, the calmness of the environment, and the warmth of the sun provide the vacationer a sense of profound relaxation. However, caution must still be taken since the chances of drowning are ever-present. In fact, an alarming national survey launched in 2014 by the American Red Cross showed that 54 percent of Americans either do not know how to swim or do not possess basic swimming skills. The lack of swimming proficiency coupled with their desire to vacation near bodies of water provide a recipe for disaster.

Leisurely swimming and relaxing by the beach are not the only methods enjoyment vacationers expose themselves to—many partake in recreational boating in order to fish, snorkel, or perform other activities that can be enjoyed further from shore. Recreational boating is also extremely dangerous and prone to accidents, especially considering how far offshore one decides to go. The United States Coast Guard releases annual reports of recreational boating accident statistics, and in 2017 it was revealed there were a total of 658 deaths as a result of recreational boating accidents. Of the deaths in which the cause was known, 76% of the victims drowned with 84.5% of the drowning victims reported as not wearing a lifejacket.

In order to stay safe while enjoying valuable vacation time, acts of precaution must take place. In one instance, larger vessels may contain emergency boats if an accident occurs. These boats are designed to carry and support the maximum number of passengers the original vessel was designed to ferry. Although lifeboats have evolved to enhance safety in every aspect, it does not control the asperity of the sea and prevent some individuals who cannot swim from toppling over. To maximize the safety of each individual, an inflatable and buoyant vest worn around one's chest is required, as it ensures protection to anyone, in any scenario. However, there are flaws with this safety design as well.

Flotation devices are often uncomfortable when worn floating atop a body of water, especially since there is no head support. If stranded for multiple hours awaiting rescue, the individual's neck may begin to ache, aggravating their anguish and preventing them from remaining calm in a dire situation. Further, flotation devices provide no protection from the harmful ultra-violet rays emitted from the sun.

Excessive exposure to UV rays can cause permanent damage to the skin and is proven to play a strong role in the development of melanoma, the most dangerous kind of skin cancer. Not to mention the development of eye problems, liver spots, wrinkles, and its many other common effects. Most regular flotation devices have no mechanism to keep other nearby stranded individuals close by without drifting away, this prevents people from staying together during a storm, heavy seas, strong currents, or rip tides unless they manually grab onto each other, which quickly depletes their much required energy.

Accordingly, there is an established need for a personal flotation device that incorporates a variety of protective, self-preservation features to promote the survival, detection, and rescue of a user who is wearing the device and stranded in a water environment.

SUMMARY OF THE INVENTION

The present invention is directed to a personal flotation, rescue, and evacuation device in the form of a sleeveless vest having a central opening that fits over the user's head. The vest includes a front portion and a rear portion, each having the form of a bib or flap construction that covers the chest and back, respectively, of the user. A lateral sleeve or pocket is disposed at a lower end of the rear portion of the vest. A buoyant structure having a pair of free ends fits through the sleeve. The free ends of the buoyant structure are wrapped around the user's waist and connected in front in a belt-like manner to form a waist belt flotation structure. The vest incorporates a hood. One hood design employs a frame component at its front rim or edge so that when deployed, the hood remains in an erect, lofted condition and creates a canopy effect surrounding the user's head. In one form, the frame component is a flotation element. The hood can be connected at its lower end to another flotation element arranged in a collar configuration to fit around the user's neck. This collar-style flotation element is connected in front to the waist belt flotation structure. The vest can be adapted to include a crotch-positioned flotation element that attaches behind the user, passes through the legs, and fastens in front to the waist belt flotation structure. In different forms, the crotch-positioned flotation element can attach at the rear of the user to either the buoyant collar element or the waist belt flotation structure.

Introducing a first embodiment of the invention, the present invention consists of a personal flotation device, comprising:

- a front section;
- a rear section;
- an intermediate section connecting the front section and the rear section;
- a head-receiving opening formed in the intermediate section proximate an upper section;
- a sleeve configured at the rear section proximate a bottom section;
- a buoyant structure having embedded looped webbing extending through the sleeve and having a pair of ends; and
- a fastener assembly configured to selectively releasably fasten the pair of ends of the buoyant structure.

In another aspect, the front section and the rear section may include at least one foam padding affixed thereto for added buoyancy.

In another aspect, the sleeve of the flotation device may extend the entire length of the lateral end of the bottom section on the rear portion of the flotation device. The buoyant structure, which passes through the sleeve, may comprise a pair of flotation tubes partially encased by a webbing or housing that leaves the ends of the flotation tubes exposed. The ends of the flotation tubes may include integrated loops thereto that engage or otherwise may be used with fasteners, such as carabiners, to secure the bottom portion of the flotation device to the mid-portion of a person.

In another aspect, the flotation device may further comprise a hood assembly that is disposed around the head-receiving opening of the device. The hood assembly, in one exemplary embodiment, may comprise a collar section extending around the head-receiving opening and attached to the rear and front portion of the device. The hood assembly may further include a shroud attached to the collar on one end and at the other connected to a support member, generally in a U-shaped configuration. When erect, the hood assembly is configured to cover the entirety of the person's head, shielding the person from the elements.

In another aspect, the hood assembly may further include light reflectors and or a light source affixed to the support member of the hood assembly.

In yet another aspect, the support member of the hood assembly may be selectively inflatable through the use of an oral inflation tube. Alternatively, the inflatable support member may be automatically inflatable through the use of a $CO_2$ cartridge.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a personal flotation, rescue, and/or evacuation device that includes a set of buoyant structures configured at multiple locations on the user's body, in addition to various implementation of a head covering to provide a canopy effect over the user's head. Although the present device may function as a flotation, rescue and/or evacuation device, for the sake of brevity the device will now simply be referred to as a personal flotation device.

Figure 1:
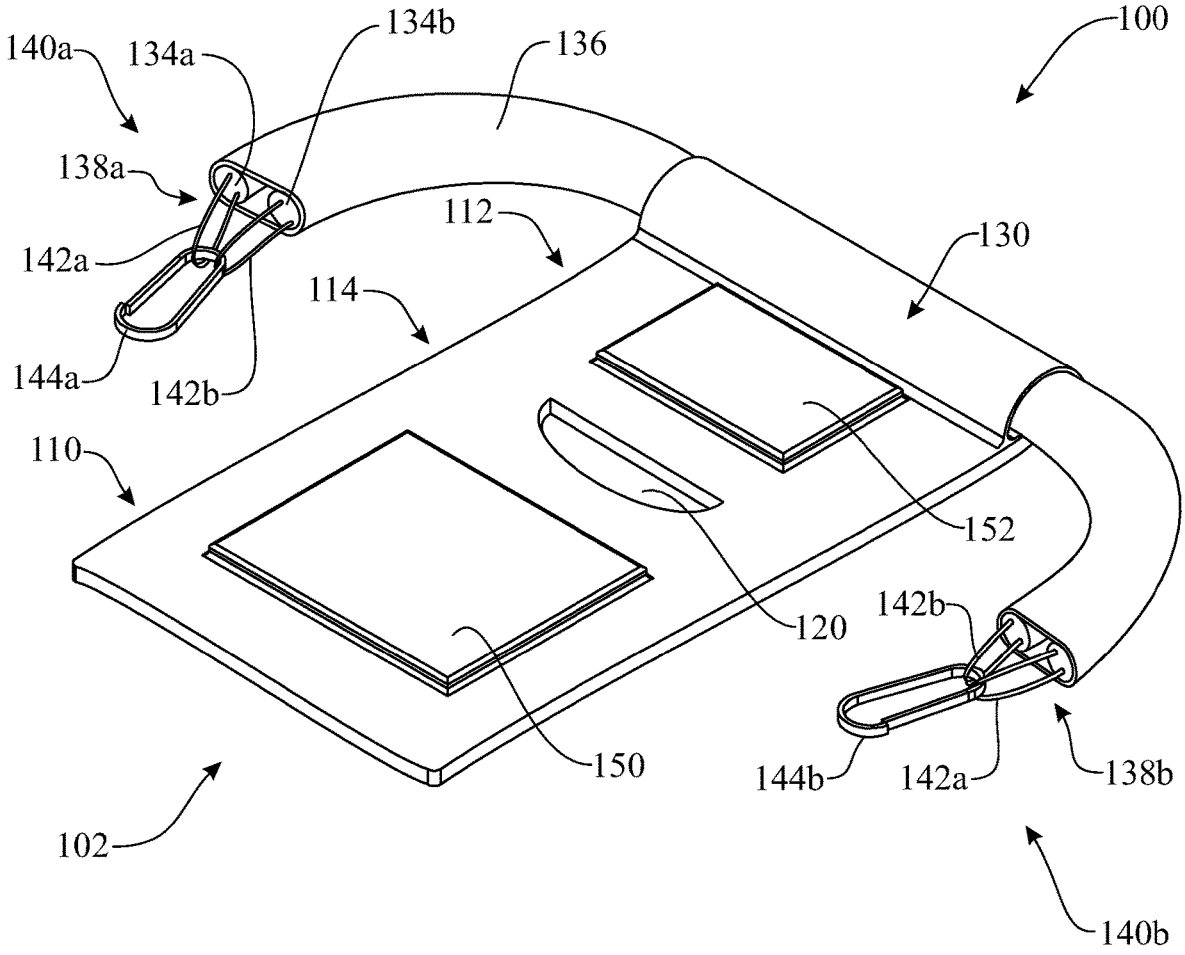
FIG. 1 presents an upper perspective view showing a first embodiment of the personal flotation device of the present invention, illustrating the device in a laid flat condition.
Figure 2:
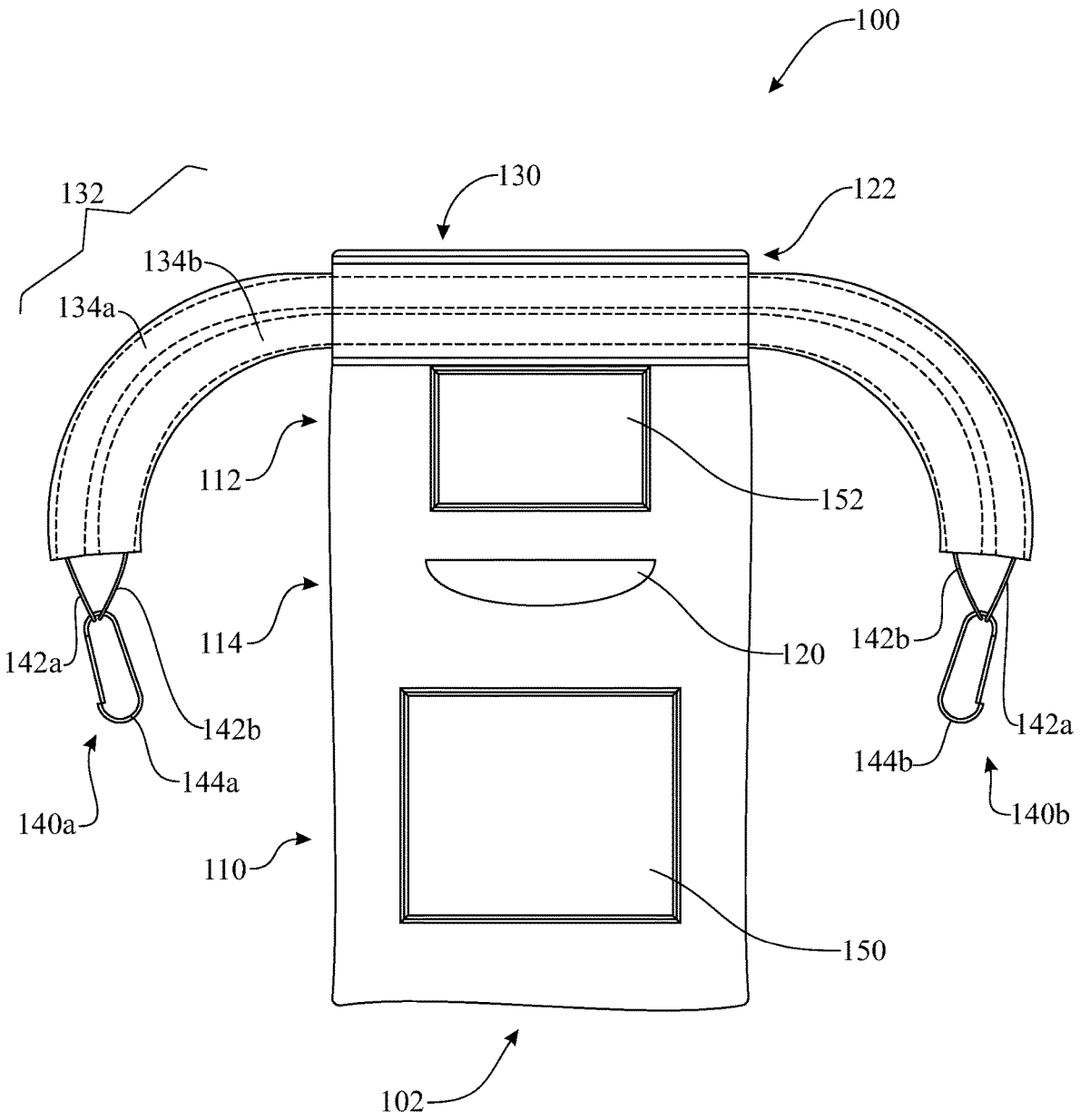
FIG. 2 presents an upper plan view of the first embodiment of the personal flotation device of the present invention, illustrating in phantom view the set of enclosed flotation units designed to be worn in a belt-like fashion.

Referring initially to FIGS. 1 and 2, a personal flotation device 100 is shown according to a first embodiment of the present invention, which can be worn by a user in a water environment to safely maintain buoyancy. The device 100 serves as the base construction design for the various other embodiments shown in FIGS. 3 through 14, which incorporate additional features.

The personal flotation device 100 is provided in the form of an overhead vest, shell or suit 102 having a generally rectangular shape and made of a flexible, pliable, lightweight material configured in a thin, planar formation suitable for covering a body. The overhead vest 102 includes a front half or chest-covering section generally illustrated at 110, a rear half or back-covering section 112, and an intermediate or shoulder-covering section 114 connecting the front section 110 and rear section 112. The front section 110 defines a front-wearing ventral or anterior portion of vest 102 configured to cover the chest of the user when vest 102 is worn. The rear section 112 defines a back-wearing dorsal or posterior portion of vest 102 configured to cover the back of the user when vest 102 is worn. The intermediate section 114 includes a head-receiving opening 120 formed generally at a middle lateral location. The vest 102 has a suspender style configuration in terms of its sleeveless design and a construction that simply requires the user to place the user's head through opening 120, which automatically situates vest 102 in its operating configuration with front vest section 110 lying on the user chest and rear vest section 112 lying on the user back.

The opening 120 in vest 102 is sized and dimensioned to enable the head of a user to fit through it. The periphery of opening 120 is preferably smaller than the circumference of a user so that once the head of the user is inserted through it, the opening 120 closes in around the neck or collar of the user to prevent vest 102 from slipping back over the head of the user and dislodging vest 102 from its overhead placement. The opening 120 will have a pliant, flexible feature that enables it to stretch and yield to accommodate the maneuvering of the user's head through opening 120, yet sufficiently elastic and resilient to return generally to its original shape and form a firm enclosure about the neck of the user. A user is attired or outfitted with vest 102 by manually placing vest 102 overhead and then locating the head through opening 120. In this worn overhead configuration, vest 102 has a natural fold line through intermediate shoulder-covering section 114, so that front section 110 spontaneously folds down and over the user's chest area and rear section 112 spontaneously folds down and over the user's back area. In this folded, worn condition, vest 102 occupies a form in which front section 110 and rear section 112 each has the configuration of a bib or flap that extends or hangs downward from intermediate section 114. Vest 102 is an article worn as a pull-on or pull-over piece of safety equipment, requiring no buttons, zippers, or other type of fasteners in the front typical of conventional life jackets having a pair of breast halves that need to be fastened together.

Vest 102 further includes a laterally extending pouch, sleeve or Kangaroo pocket 130 formed at a lower end 122 of rear vest section 112. Sleeve 130 is open-ended at both ends and preferably extends substantially the full width of vest 102 from one open end to another. The sleeve 130 is preferably configured at an appropriate location on rear vest section 112 in order to extend over the lumbar region of a user wearing device 100. Device 100 further includes a waist belt buoyant structure generally illustrated at 132, such as an exemplary set of individual flotation tubes 134*a,b* that are bundled together with a set of high strength tubular webbing and encased or wrapped in a sheath or carrier 136. The set of flotation tubes 134*a,b*, and webbing as bundled in carrier 136, extend or thread through sleeve 130 in a symmetrical manner. The waist belt buoyant structure 132 has a pair of free attachment ends 138*a,b* corresponding to the ends of flotation tubes 134*a,b*. The waist belt buoyant structure 132 is configured at each free attachment end 138*a,b* with a respective fastener assembly generally illustrated at 140*a,b*. Each fastener assembly 140*a,b* includes, in combination, a staple, hook or closed loop 142*a,b* extending from the respective ends of flotation tubes 134*a,b* that are attached or integrated to the webbing; and, a spring-loaded carabiner clip 144*a,b* that is hooked or linked onto hooks 142*a,b*. In operation, as illustratively depicted in FIG. 3, the waist belt buoyant structure 132 is pulled around the waist of the user in belt-like fashion and the free attachment ends 138*a,b* of buoyant structure 132 are coupled together by linking the pair of carabiner clips 144*a,b* from the pair of fastener assembly 140*a,b*. This linkage is releasable by appropriately pivoting the normally closed gate of one of the carabiner clips 144*a,b*.

The waist belt buoyant structure 132 includes any suitable number of flotation tubes 134*a,b* adequate to provide sufficient buoyancy to a user who is wearing vest 102 and is deploying buoyant structure 132 in belt-like fashion to cinch vest 102, while floating in a water environment. The flotation tubes or strips 134*a,b*, which can be made of a closed-cell buoyant foam or its equivalent, have a generally elongate or noodle-like structure and may be provided in any shape, such as circular or tubular, or folded strips. The flotation tubes 134*a*.b, may be integrated or attached to a set of tubular webbing. The flotation tubes 134*a,b* are flexible articles, enabling them to be readily manipulated into their belt-like configuration about the user's waist. The flotation tubes 134*a,b* may be provided with normally curved sections to facilitate ease of grabbing the ends 138*a,b* of buoyant structure 132 in order to fasten and secure them together. Alternately, the flotation tubes 134*a,b* can be formed with a straight contour, which is no impediment to their being maneuvered around the waist due to their flexible, pliant construction. The flotation tubes 134*a,b* of buoyant structure 132 have a sufficient length so that once deployed and secured at ends 138*a,b* using fastener assembly 140*a,b*, the fastened buoyant structure 132 encircles the user's body in such a manner to cover the lumber region, wrap around the user bilaterally to cover both sides of the user's body at the rib area, and extend significantly across the abdominal area, leaving a gap where the pair of fastener assembly 140*a,b* is linked at the pair of carabiner clips 144*a,b*.

The vest 102 can optionally include a front padding 150 affixed to vest 102 in a generally central location of front vest section 110, preferably covering the chest area. The front padding 150 is designed to provide the user with a protective cushion to protect the user's chest from impact with objects (or other individuals) floating in the water, such as flotsam or jetsam. Additionally, vest 102 can optionally include a rear padding 152 affixed to vest 102 in a generally central location of rear vest section 112, preferably covering the upper back area. The rear padding 152 offers a similar protective cushion benefit as front padding 150. The front padding 150 and rear padding 152 are made of a suitable impact-absorbent material, such as foam. Moreover, the front padding 150 and rear padding 152 can be sized and dimensioned in any suitable manner fit for its purposes, such as the exemplary rectangular shape shown in FIGS. 1 and 2.

Figure 3:
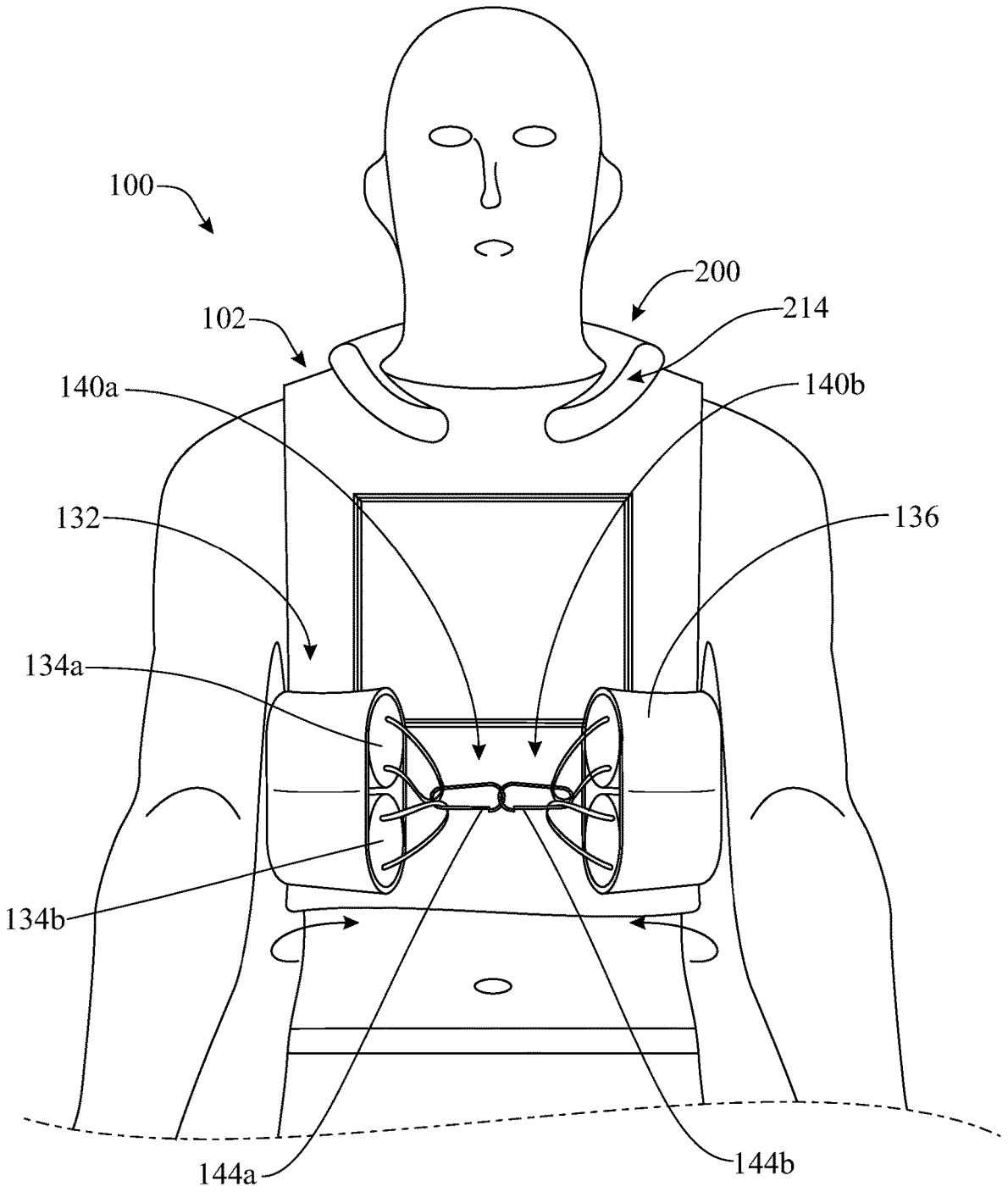
FIG. 3 presents a front plan view showing a second embodiment of the personal flotation device of the present invention, illustrating a user wearing the device incorporating a hood.
Figure 4:
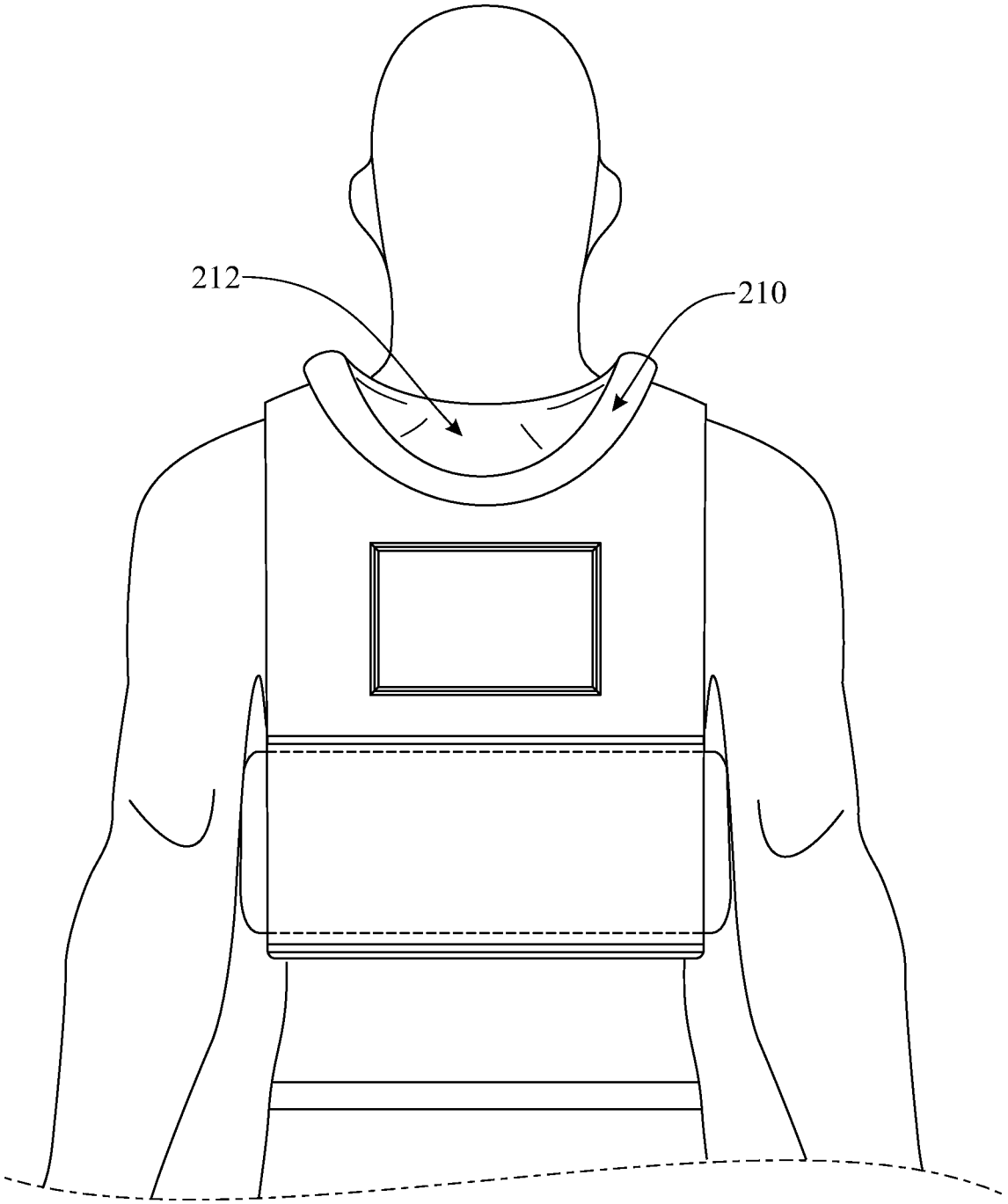
FIG. 4 presents a rear plan view of the second embodiment of the personal flotation device of the present invention, illustrating the location of the hood integral with the device.

Referring now to FIGS. 3 and 4, the personal flotation device 100 shown in FIGS. 1 and 2 is modified to incorporate a hood or head covering mechanism generally illustrated at 200, according to a second embodiment of the present invention. The personal flotation device 100 of FIGS. 1 and 2 serves as the base design adapted to integrate hood 200. Hood 200 is incorporated as an integral piece of vest 102 and drapes down behind the user at rear section 112 of vest 102 when not deployed (FIG. 4).

Hood 200 includes a rim or edge portion 210 bordering a head-covering portion 212. In one form, the rim 210 includes a collar section 214 extending onto the front section 110 of vest 102 from both sides, tracing across the user's shoulder and collarbone and terminating at a point generally under the user's chin. This collar section 214 enables hood 200 to envelop and wrap more closely around the user's head and face when deployed, a benefit to promote heat conservation surrounding the user's head and to protect the user's head and face from adverse ambient weather conditions. The rim 210 of hood 200 may be formed of a reinforced or thickened material to maintain the integrity of hood 200 and to add structural support and firmness, particularly since hood 200 may be exposed to harsh water and weather elements. The construction of hood 200 may utilize any suitable material compatible with water protection, such as a water-resistant, water-impermeable, and/or breathable fabric. As depicted in FIGS. 3 and 4, a user is shown wearing personal flotation device 100. In order to secure vest 102 by fastening buoyant structure 132, the user pulls both ends 138*a,b* of waist belt buoyant structure 132 around the waist in belt-like fashion and then fastens these ends 138*a,b* together using the fastener assembly 140*a,b*, specifically by securing carabiner clips 144*a,b*. The user can manually deploy hood 200 in a conventional manner by drawing it over the head.

Referring now to FIGS. 5 through 9, the personal flotation device 100 shown in FIGS. 1 and 2 is modified to incorporate a canopy-type hood or head covering generally illustrated at 300 that employs a flotation tube as a frame component at an upper section, according to a third embodiment of the present invention. The personal flotation device 100 of FIGS. 1 and 2 serves as the base design adapted to integrate head-covering canopy 300. As discussed further, the design of hood 300 employs a frame component at its front rim or edge so that when deployed, the hood 300 remains in an erect, taut, lofted condition and creates a canopy effect surrounding the user's head.

Hood 300 includes, in combination, a movable buoyant support element 310 defining the front edge or rim of hood 300; a buoyant collar element 312 positioned around the neck of the user and connected in front to the waist belt buoyant structure 132 fastened around the user's waist; and, a shroud member 314 extending between the buoyant support element 310 and buoyant collar element 312 to define a head covering. In one form, the buoyant collar element 312 is a separate flotation-type article that is wrapped or folded around the user's neck in a generally U-shaped configuration and attached at its ends to form a loop. The buoyant collar element 312 has a pair of ends 320*a,b* that are fastened to one another and jointly fastened to the waist belt buoyant structure 132 fastened around the user's waist. For this purpose, the buoyant collar element 312 is equipped with a fastener assembly generally illustrated at 322 including, in combination, a pair of hooks 324*a,b* each extending from a respective one of the ends 320*a,b* of buoyant collar element 312, and a releasable carabiner clip 326. In an exemplary embodiment, the buoyant collar element may include tubular webbing that forms the pair of hooks 324*a,b* that are seen in the exemplary figures. The carabiner clip 326 is jointly linked at an upper end to the pair of hooks 324*a,b* attached to the pair of ends 320*a,b* of buoyant collar element 312, and jointly linked at a lower end to the pair of carabiner clips 144*a,b*, which fasten together the ends 138*a,b* of the waist belt buoyant structure 132 worn in belt-like fashion around the user's waist. This linkage serves several functions. First, the linkage secures the buoyant collar element 312 about the user's neck by fastening together its pair of ends 320*a,b* to form a closed-loop flotation ring. Second, the linkage maintains the buoyant collar element 312 in a stable position by fastening it to the waist belt buoyant structure 132 disposed below it.

Figure 5:
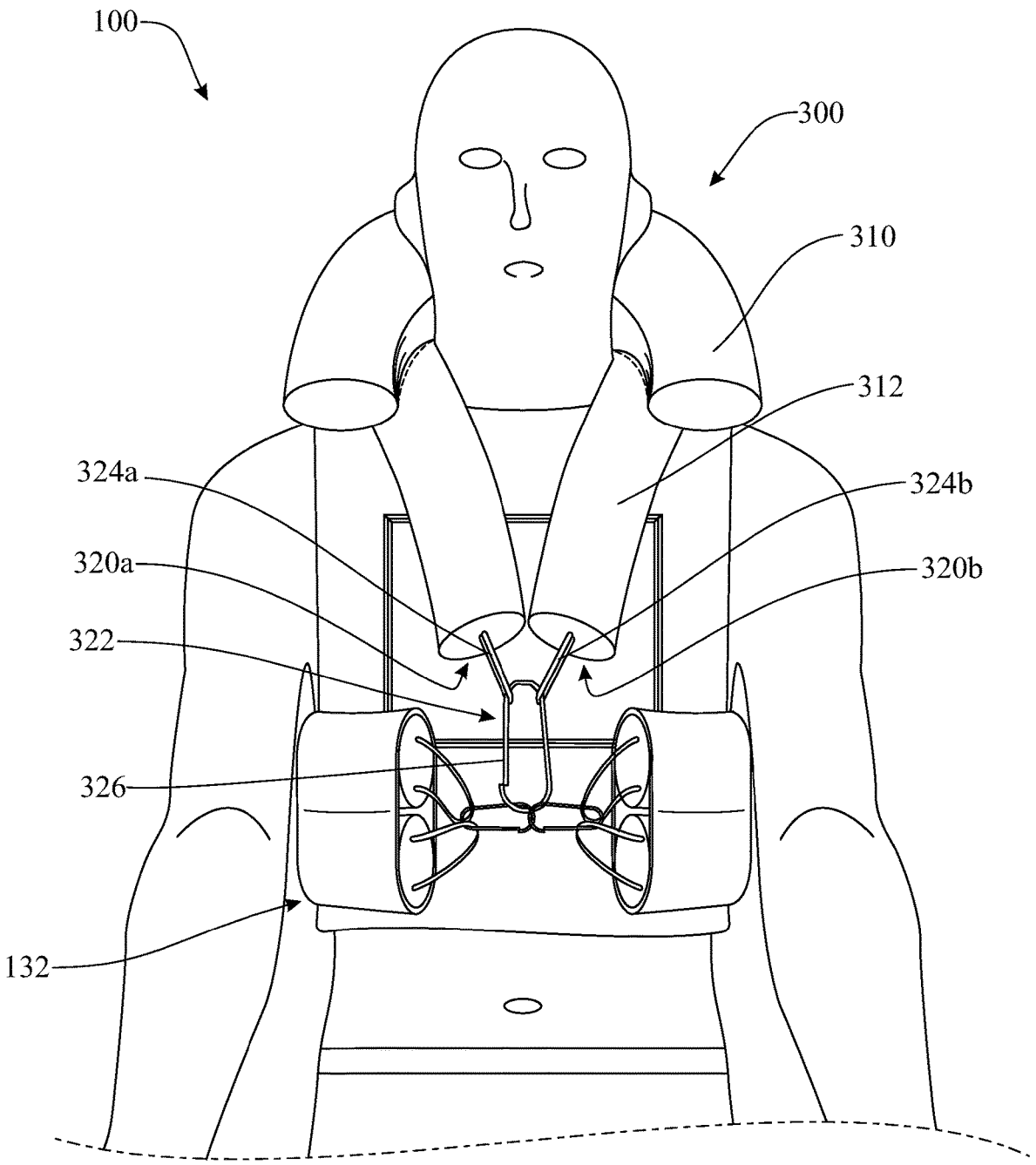
FIG. 5 presents a front plan view showing a third embodiment of the personal flotation device of the present invention, illustrating a user wearing the device incorporating a hood having one buoyant element as a collar and another buoyant element as a frame.
Figure 7:
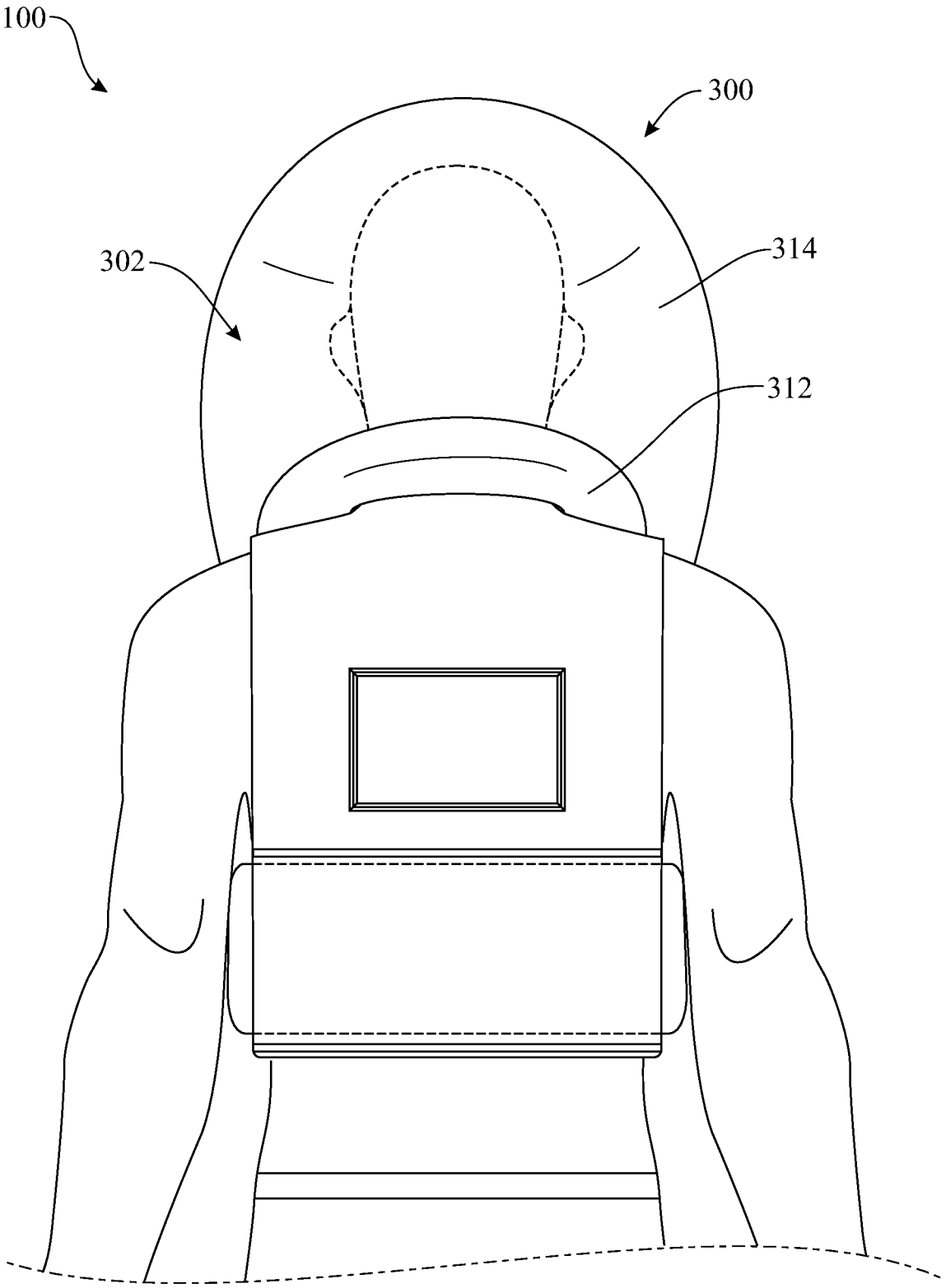
FIG. 7 presents a rear plan view of the third embodiment of the personal flotation device of the present invention, illustrating the hood in its deployed configuration and showing the lateral, shoulder area coverage provided by the hood.
Figure 8:
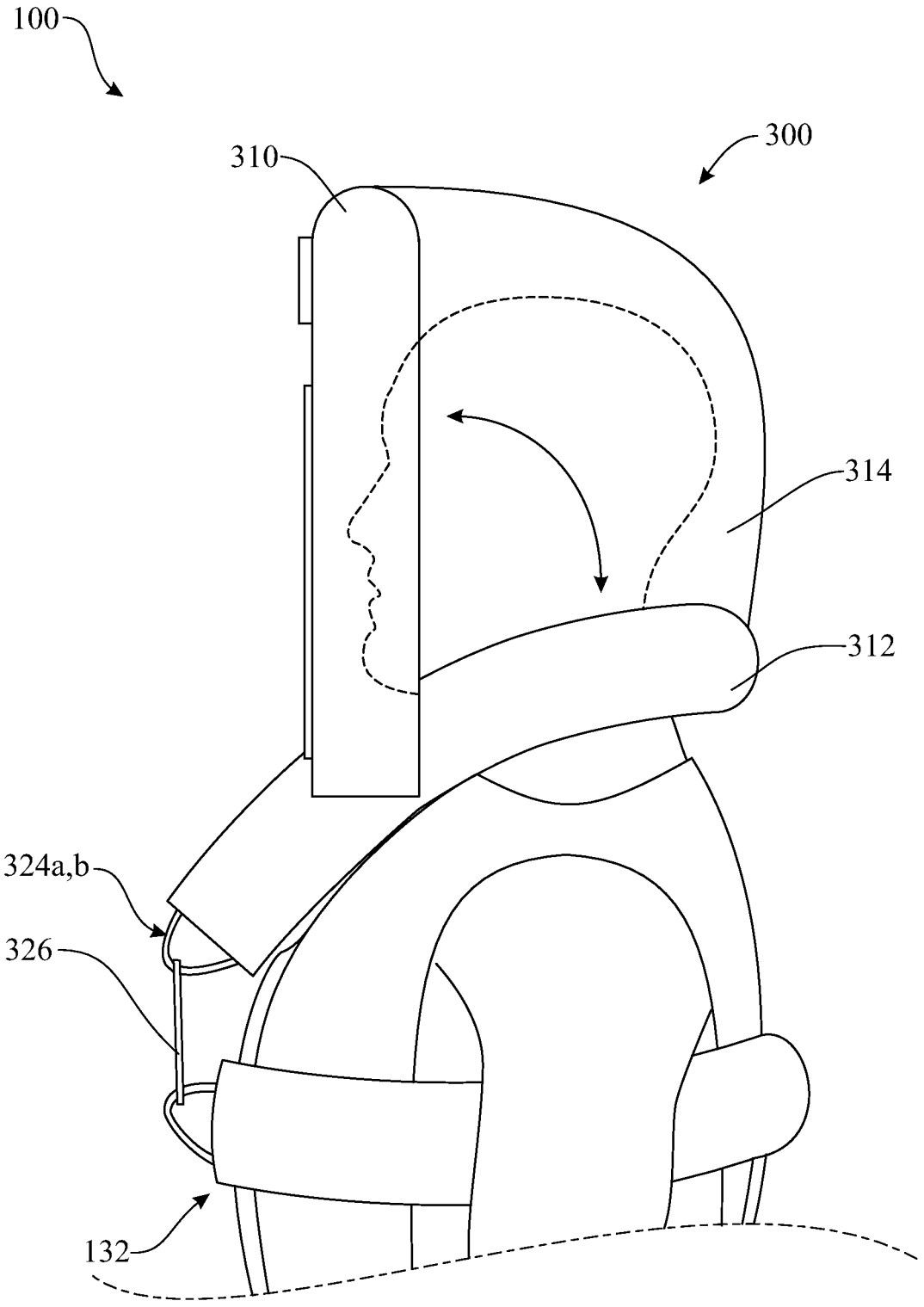
FIG. 8 presents a side plan view of the third embodiment of the personal flotation device of the present invention, illustrating the framed hood in its deployed configuration and showing both the overhead clearance and the forward extension of the hood.

The support element 310 has a generally U-curved shape and, in a non-deployed state, rests behind the user in a position similar to that of a neck rest travel pillow (FIG. 5). The support element 310 forms a suitably rigid frame element at the front edge or rim of hood 300 so that, upon deployment of hood 300 (FIG. 6), support element 310 props up shroud 314 to maintain it in a canopy-like manner over the user's head (FIGS. 7 and 8). The support element 310, once pulled and otherwise maneuvered into its most forward position spanning the user's head to actualize full deployment of hood 300, maintains shroud 314 in a taut condition and keeps it in a raised, elevated position over the user's head. The deployed shroud 314 provides an interior bubble-like coverage space generally illustrated at 302 that envelops the user's head and provides adequate clearance in all directions, forming a cocoon-like feature surrounding the user's head and neck area. Hood 300 is unlike other hood designs that are unsupported and so simply fall onto the user's head and drape over it when pulled overhead. The shroud 314 is preferably made of a suitable waterproof or weather-proof (water-resistant or water-repellent) material.

Figure 9:
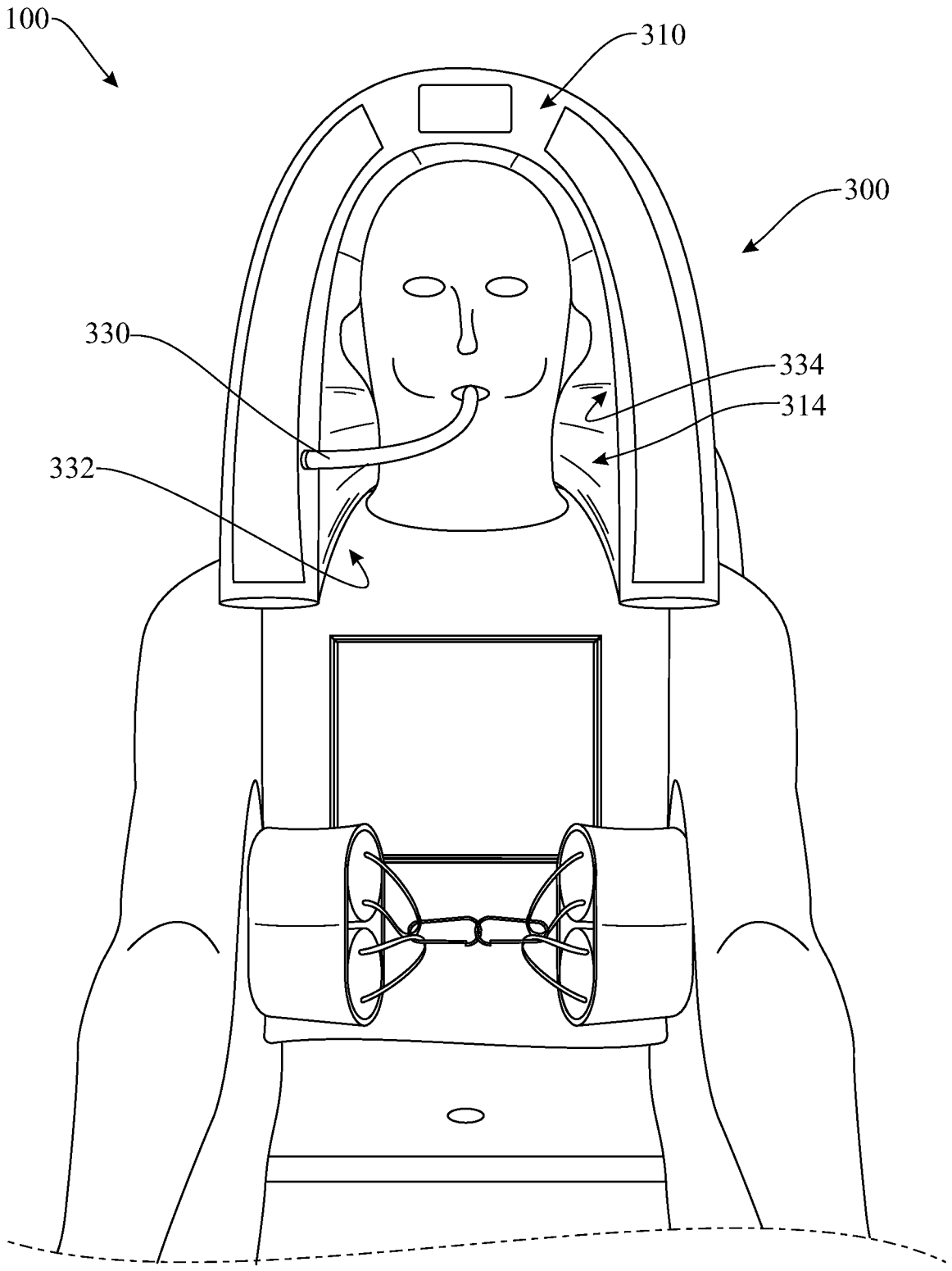
FIG. 9 presents a front plan view of the third embodiment of the personal flotation device of the present invention, incorporating a mouth-operated tube to allow the user to manually inflate a flotation element integrated with the hood.

Referring still to FIGS. 5-9, with emphasis on FIG. 9, the buoyant support element 310 can be provided in various alternate implementations. The buoyant support element 310 can be configured as a ready-made flotation structure that is inherently buoyant in its wear-ready condition. Alternately, buoyant support element 310 can be provided in a water-activated form that automatically inflates when it is exposed or placed into contact with water. Additionally, buoyant support element 310 can be provided as a normally non-inflated tube that can be manually inflated by the user using an oral inflation tube 330. In one alternative implementation of hood 300, such as shown in FIG. 9, the hood 300 is assembled with shroud member 314 connected at its lower edge 332 to vest 102, making hood 300 integral with vest 102. For this purpose, since shroud member 314 is directly connected to vest 102, there is no need for a buoyant collar element 312 such as depicted in FIGS. 5-8. The shroud member 314 is still connected at its upper edge 334 to buoyant support element 310.

Figure 6:
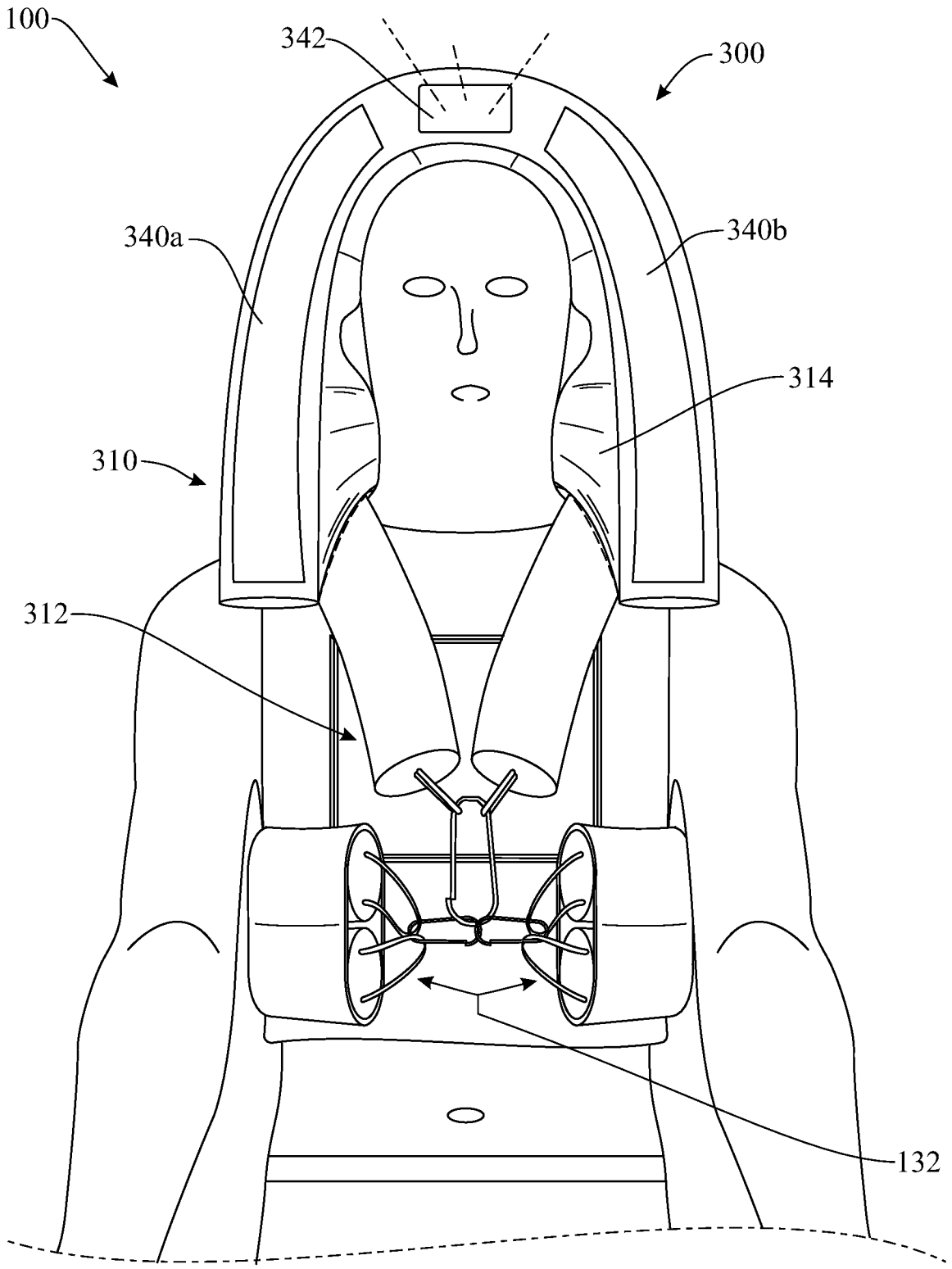
FIG. 6 presents a front plan view of the third embodiment of the personal flotation device of the present invention, illustrating the hood in its deployed configuration and incorporating a distress signal indicator integrated with the hood.

Referring to FIG. 6, the personal flotation device 100 can optionally include a beacon system incorporating a variety of signaling or notification features or markings that help identify the presence of a user and facilitate rescue efforts. For example, device 100 can include a set of light reflectors 340*a,b* affixed to buoyant support element 310 and/or one or more illuminators or light-emitting diodes (LEDs) 342 affixed to buoyant support element 310. The LED 342 can be water-activated and turned on when exposed to water or activated when hood 300 is deployed.

Figure 10:
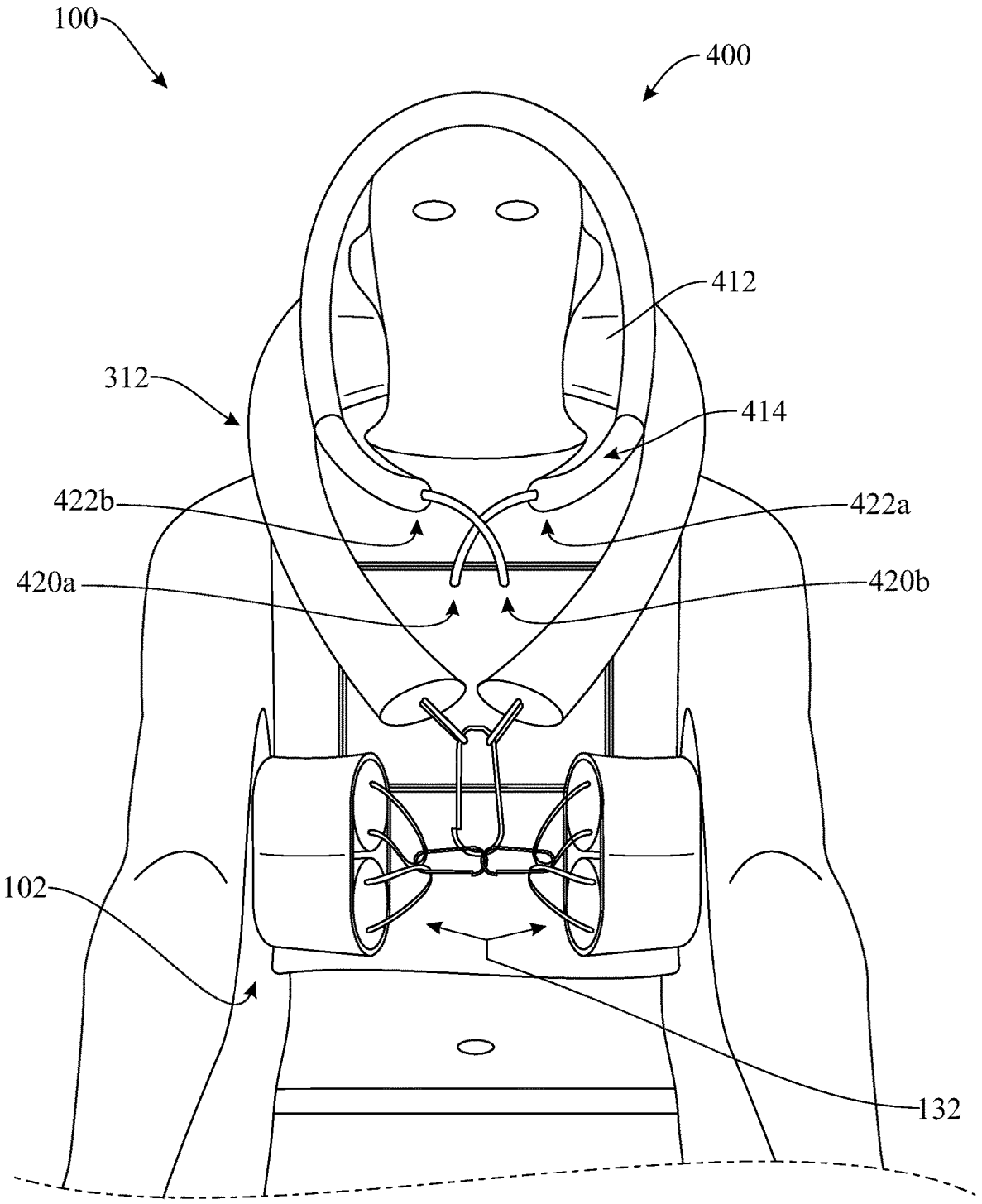
FIG. 10 presents a front plan view showing a fourth embodiment of the personal flotation device of the present invention, illustrating a user wearing the device incorporating a hood and a draw string to cinch the hood over the user's head.

Referring now to FIG. 10, the personal flotation device 100 shown in FIGS. 1 and 2 is modified to incorporate a hood or head covering generally illustrated at 400 that employs a means to cinch or secure the hood at the front, according to a fourth embodiment of the present invention. The personal flotation device 100 of FIGS. 1 and 2 serves as the base design adapted to integrate hood 400. The hood 400 is similar to hood 200 shown in FIGS. 3 and 4, but adapted to include a pair of draw strings or cinch cords 420*a,b* each attached to a respective one of the ends 422*a,b* of hood collar 414. The draw strings 420*a,b* enable the user to pull the hood 400 closer to the user's head in a tighter, close-fitting seal. The hood 400 and buoyant collar element 312 can be combined in different ways. In one form, the buoyant collar element 312 can be employed separately and independently from hood 400, i.e., hood 400 is integrally connected with vest 102, while the buoyant collar element 312 can be offered as a separate, supplemental piece of equipment for selective combination with vest 102. In an alternate form, hood 400 can be integrally attached to the buoyant collar element 312 at head covering 412 of hood 400, making the combination of hood 400 and buoyant collar element 312 a single integrated piece.

Figure 11:
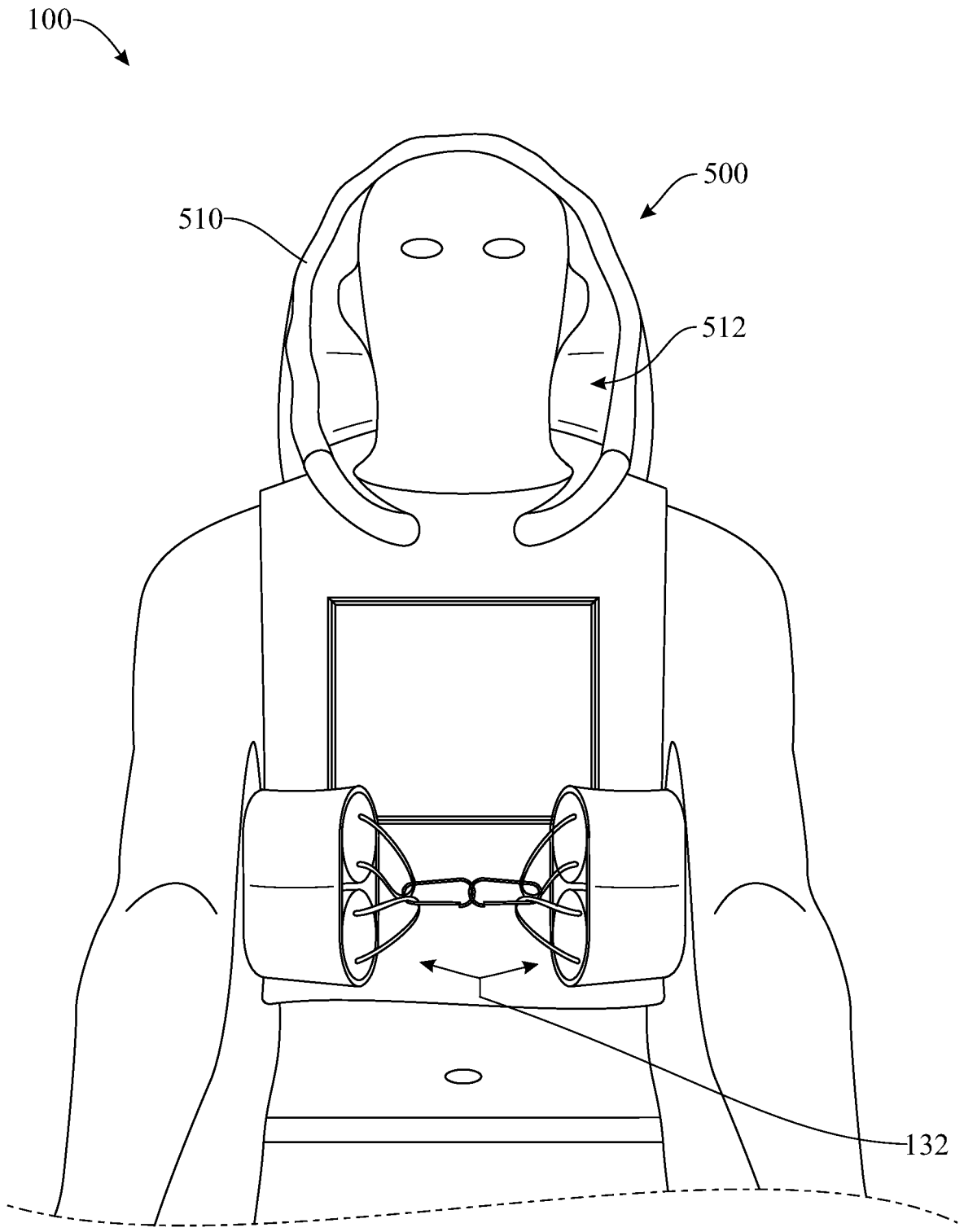
FIG. 11 presents a front plan view showing a fifth embodiment of the personal flotation device of the present invention, illustrating a user wearing the device incorporating a hood and a rigid member to form the frame at the front edge of the hood.

Referring now to FIG. 11, the personal flotation device 100 shown in FIGS. 1 and 2 is modified to incorporate a hood or head covering generally illustrated at 500 that employs a frame component to support the hood in an erect position and create a canopy effect over the user's head, according to a fifth embodiment of the present invention. The personal flotation device 100 of FIGS. 1 and 2 serves as the base design adapted to integrate hood 500. The hood 500 is similar to hood 200 shown in FIGS. 3 and 4, but adapted to include a rigid rib member 510 that defines the front edge or rim of hood 500. The rib member 510 functions as a frame component that supports the head-covering portion or shroud 512 of hood 500 in a lofted or suspended fashion overhanging the user's head in the manner of a canopy. The front edge support afforded by rib member 510 to hood 500 keeps the head covering 512 propped up, which maintains a clearance space about the user's head and sustains the head covering 512 in a spaced-apart enveloping relationship to the user's head. The rib member 510 can be implemented with any type of suitable solid structure, such as a flexible material that permits some bending to rib member 510 or an inflexible, rigid structure.

Figure 12:
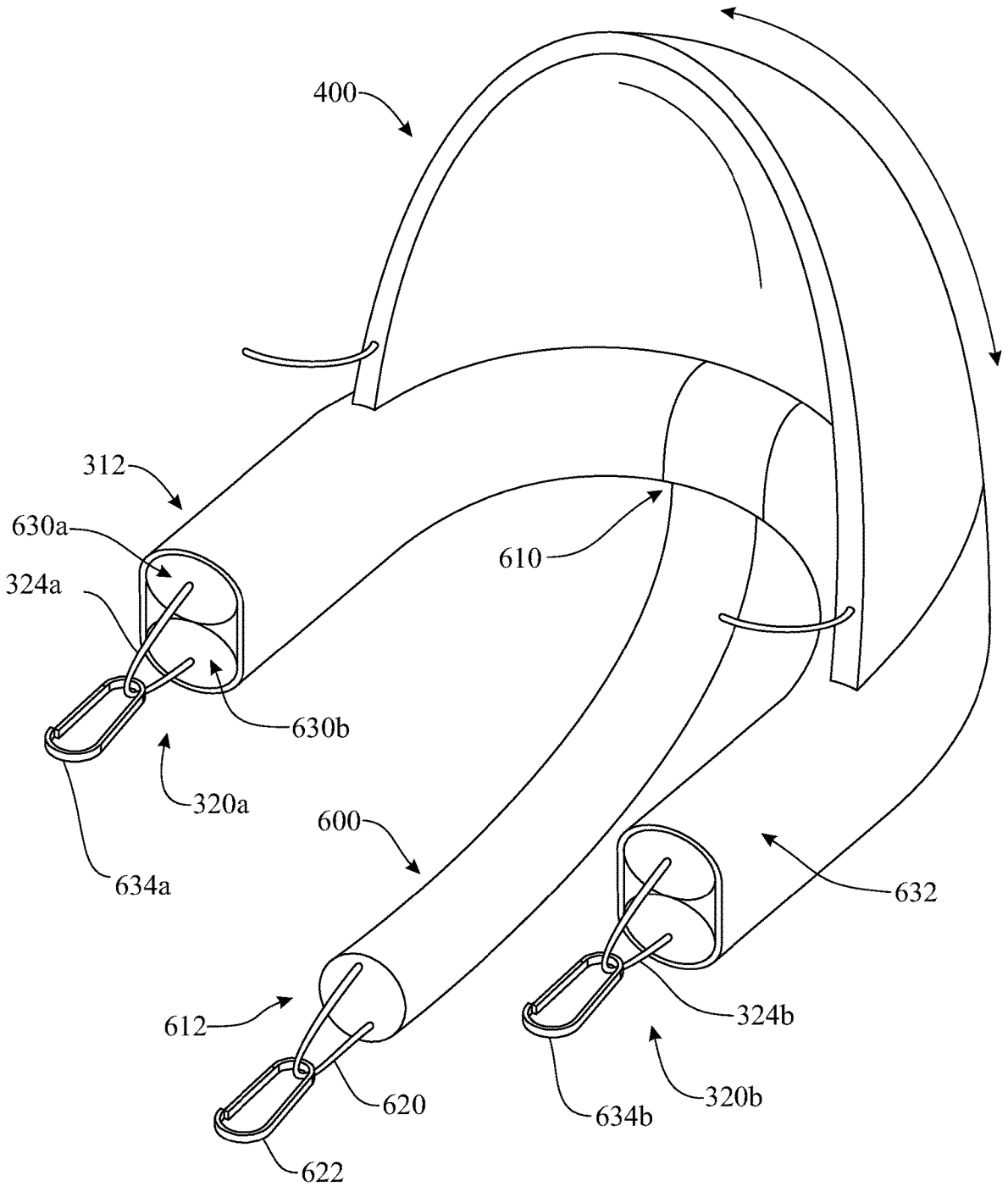
FIG. 12 presents a front perspective view showing a sixth embodiment of the personal flotation device of the present invention, showing a flotation system incorporating a buoyant structure passing through the crotch of the user and fastening either to the main buoyant assembly worn as a waist belt or the supplemental buoyant element worn as a collar.

Referring now to FIG. 12, the personal flotation device 100 shown in FIGS. 1 and 2 is adapted to incorporate a crotch-spanning flotation component 600 that extends from back to front between the user's legs to form a harness, according to a sixth embodiment of the present invention. The personal flotation device 100 of FIGS. 1 and 2 serves as the base design adapted to integrate crotch-spanning component 600. Component 600 may be made out of buoyant material, webbing, or a composite of both. Although component 600 is shown in FIG. 12 as part of device 100 modified according to the embodiment of FIG. 10 (specifically in relation to hood 400), this implementation is meant for illustrative purposes only as any form or configuration using personal flotation device 100 as its base design can integrate component 600.

The crotch flotation component 600 includes a rearward secured end 610 and a forward free attachment end 612. The secured end 610 is attached to the buoyant element 312 (i.e., in the rear or behind the user), while the free attachment end 612 is releasably secured to the waist belt buoyant structure 132 (i.e., in front of the user). For attachment purposes, component 600 is equipped with a hook 620 extending from free end 612 and a carabiner clip 622 clipped onto hook 620. During deployment, the crotch flotation component 600 is passed between the legs of the user and secured to the waist belt buoyant structure 132 looped around the waist of the user. In particular, the carabiner clip 622 at the free attachment end 612 of component 600 is fastened jointly to the pair of carabiner clips 144*a,b* serving to fasten together the free ends 138*a,b* of waist belt buoyant structure 132 (FIGS. 1 and 3). In this configuration linking the crotch flotation component 600 at one end 610 to buoyant collar element 312 and at another end 612 to waist belt buoyant structure 132, the crotch flotation component 600 passes medially along the spine of the user before routing between the user's legs through the crotch area and emerging in front of the user. In an alternate configuration, the crotch flotation component 600 is attached at its rearward secured end 610 to the waist belt buoyant structure 132, such as behind the user at sleeve 130 through which the waist belt buoyant structure 132 passes. The crotch flotation component 600 is similarly attached at its front free attachment end 612 to the free ends 138*a,b* of waist belt buoyant structure 132 (i.e., in front of the user).

In the implementation shown in FIG. 12, the buoyant collar element 312 is configured with a pair of flotation tubes 630*a,b* bundled together and carried in a sheath or carrier 632, although any number of flotation tubes can be bundled together. At each one of the pair of free ends 320*a,b* of buoyant collar element 312, one of a pair of hooks 324*a,b* is provided (see also FIG. 5), each having a prong extending from an end of one of the flotation tubes 630*a,b*. A pair of carabiner clips 634*a,b* are provided, each one clipped into one of the pair of hooks 324*a,b* disposed at the free ends 320*a,b* of buoyant collar element 312 (i.e., flotation tubes 630*a,b*). During deployment, the buoyant collar element 312 is secured to the waist belt buoyant structure 132. In order to establish this connection, each one of the pair of carabiner clips 634*a,b* associated with buoyant collar element 312 is clipped into one of the pair of carabiner clips 144*a,b* available at the free attachment ends 138*a,b* of waist belt buoyant structure 132 (FIGS. 1 and 3). As shown, hood 400 is connected to buoyant collar element 312 at the carrier 632 enveloping the pair of inner flotation tubes 630*a,b*.

Figure 13:
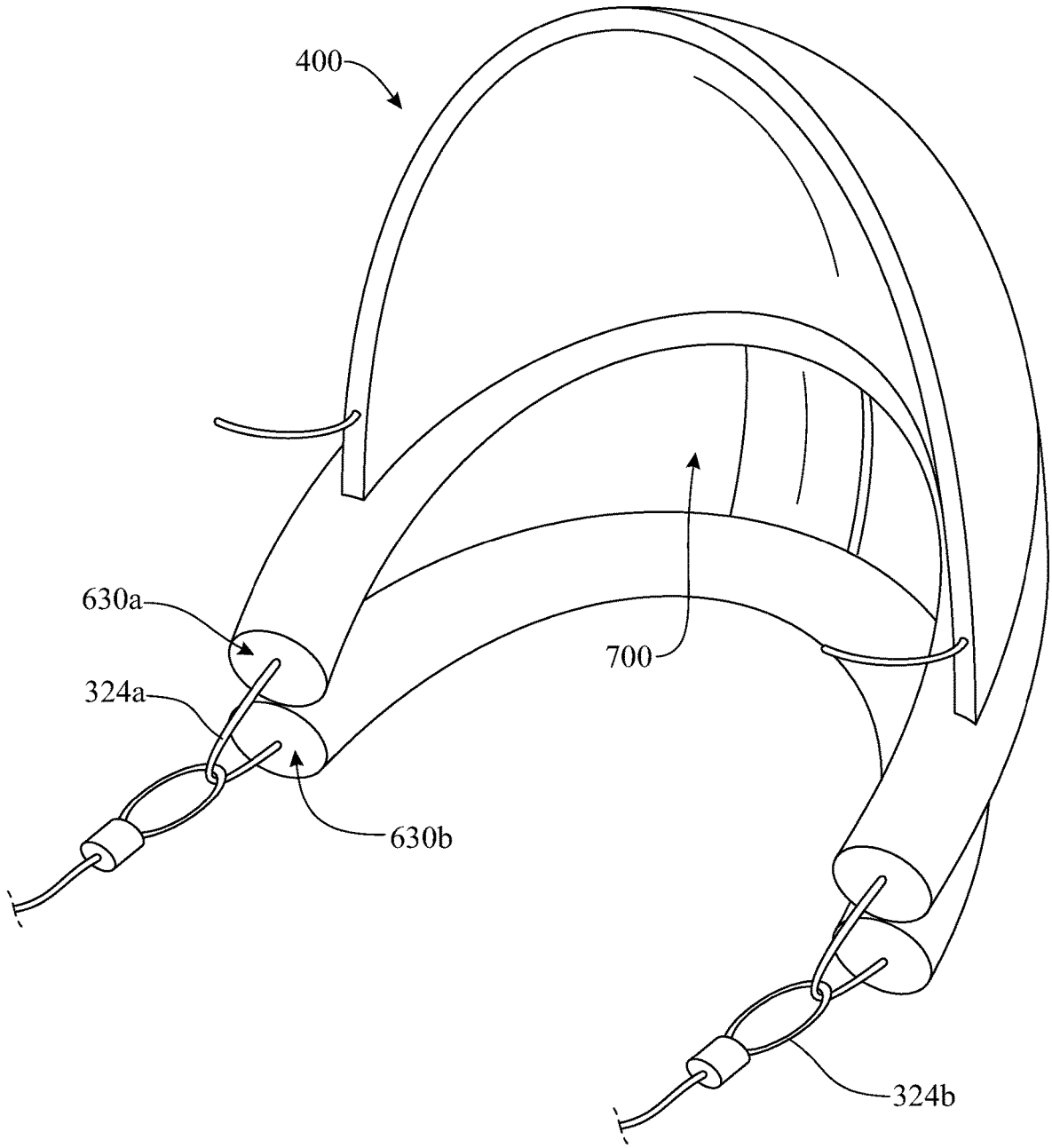
FIG. 13 presents a front perspective view showing a seventh embodiment of the personal flotation device of the present invention, showing how a buoyant element worn as a collar is adapted to incorporate a webbing connecting the individual flotation tubes of the buoyant collar element.

Referring now to FIG. 13, the personal flotation device 100 shown in FIGS. 1 and 2, as modified to incorporate the buoyant collar element 312 (FIGS. 5-8), is adapted from the configuration shown in FIG. 12 (which in turn derives from FIG. 10) to incorporate a webbing generally illustrated at 700, according to a seventh embodiment of the present invention. The personal flotation device 100 of FIGS. 1 and 2 serves as the base design adapted to integrate webbing 700. Although webbing 700 is shown in FIG. 13 as part of device 100 modified according to the embodiments of FIGS. 10 and 12 (specifically in relation to hood 400), this implementation is meant for illustrative purposes only as any form or configuration using personal flotation device 100 as its base design can integrate webbing 700.

For purposes of integrating webbing 700, the bundled pair of flotation tubes 630*a,b* enclosed in carrier sheath 632 (FIG. 12), which constitute the buoyant element 312, are removed from their sheathing so that they can be separated in a spaced-apart relationship, as shown in FIG. 13. The webbing 700 extends between the spaced-apart flotation tubes 630*a,b*. The webbing 700 provides a measure of protection to cover a portion of the user's upper back, without compromising the effectiveness of the flotation tubes 630*a,b*. Although now spaced apart, the flotation tubes 630*a,b* are still hooked together at their free ends by the pair of hooks 324*a,b*, enabling the flotation tubes 630*a,b* to be secured in tandem to the waist belt buoyant structure 132 in the same manner as set forth in connection with FIG. 12.

Figure 14:
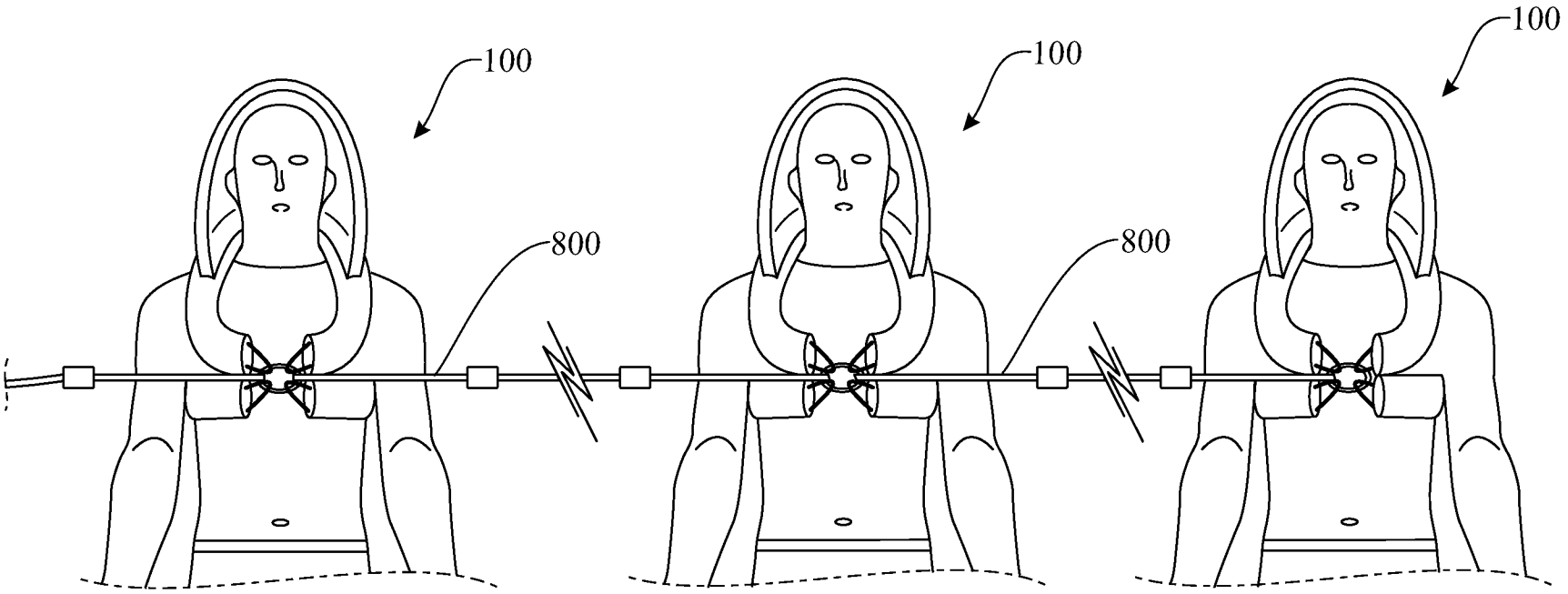
FIG. 14 presents a front plan view showing an eighth embodiment of the personal flotation device of the present invention, illustrating the use of a releasable line to tether together several individuals each wearing the personal flotation device of the present invention.

Referring now to FIG. 14, the personal flotation device 100 shown in FIGS. 1 and 2 is adapted to incorporate a tether line 800 in order to connect together two or more individuals wearing the personal flotation device 100, according to an eighth embodiment of the present invention. The tether line 800 can be provided in various forms. In one form, the tether line 800 has a proximal attachment end and a distal free end. The proximal attachment end is equipped with a suitable fastener that can be secured to the user's waist belt buoyant structure 132, preferably by establishing a linkage to the fastener assembly 140*a,b* that connects together the free attachment ends 138*a,b* of waist belt buoyant structure 132. The distal free end is equipped with another suitable fastener that can be similarly secured to the waist belt buoyant structure 132 of another personal flotation device 100 worn by another user. In this implementation, a single tether line 800 links together two users each wearing the personal flotation device 100. In another form, the tether line 800 has a proximal attachment end and a distal free end. The proximal attachment end would have a similar fastening feature to secure the tether line to the user's waist belt buoyant structure 132. The distal free end would have a fastener mechanism that enables linkage to the distal free end of another tether line 800 hooked to the personal flotation device 100 of another user. In this implementation, each user possesses an individual tether line 800 that connects at its distal free end to the distal free end of another tether line 800 worn by another user. In all its forms, the tether line 800 is a high-strength coupling that keeps the individual members of a party connected together in a daisy chain arrangement, ensuring that members do not drift away from one another. In yet another form, the high-strength couplings also facilitate rescue and evacuation efforts. For example, in a rescue or evacuation effort, the coupling hooks on the waist belt on the buoyant structure are designed or otherwise configured to attach and support a tether line 800 of sufficient strength that enables a rescue mechanism to retrieve a user simply by hooking onto the tether line 800 (e.g., winch hook) and collecting the hooked individual (e.g., winching operation). For instance, in an exemplary rescue scenario that involves a user wearing the device at sea and a search and rescue helicopter, the rescue device obviates the need of any operator having to enter the water to rescue the user. Indeed, instead of jumping in the water a rescuer casts a line from the helicopter hovering over the user wearing the floatation and rescue device. After receiving the line, the user wearing the device connects the line extending from the helicopter and attaches it to the couplings formed on the device. The rescuer then uses a winching mechanism, typically found in rescue helicopters, to lift the user out of the water and into the safety of the helicopter without having to enter or otherwise endanger any of the lives of the rescuers. Moreover, similar rescue procedures can be employed by rescuers who are onboard ships, rescue crafts or their equivalent.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A personal flotation device, comprising:

a front section;

a rear section;

an intermediate section connecting the front section and the rear section;

a head-receiving opening formed in the intermediate section proximate an upper section;

a sleeve configured at the rear section and proximate a bottom section;

a buoyant structure having embedded looped webbing extending through the sleeve and having a pair of ends;

a flotational hood assembly disposed about the head-receiving opening, wherein the flotational hood assembly includes a set of light reflectors affixed to a hood support element of the hood assembly; and a fastener assembly configured to selectively releasably fasten the pair of ends of the buoyant structure.

2. The personal flotation device of claim 1, wherein the front section includes at least one foam padding for added buoyancy.

3. The personal flotation device of claim 1, wherein the rear section includes at least one foam padding for added buoyancy.

4. The personal flotation device of claim 1, wherein the sleeve extends an entire lateral end of the bottom section of the rear section of the device.

5. The personal flotation device of claim 1, wherein the buoyant structure comprises a pair of flotation tubes partially encased by a webbing having open ends exposing the pair of ends of the flotation tubes, the ends of each flotation tube having at least one integrated loop engageable with a fastener that is usable to secure the bottom portion of the flotation device to a person's mid-section.

6. The personal flotation device of claim 1, wherein the fasteners comprise carabiner clips.

7. The personal flotation device of claim 1, wherein the flotational hood assembly comprises a collar section extending around the head-receiving opening and attached to the rear section and the front section of the flotation device with a pair of ends terminating at a point below a mid-portion off the head-receiving opening.

8. The personal flotation device of claim 7, wherein the collar section comprises a flotation tube encased in a webbing.

9. The personal flotation device of claim 1, wherein the flotational hood assembly comprises a collar section attached to the front section and the rear section of the flotation device a shroud, and a deployable hood.

10. The personal flotation device of claim 9, wherein the deployable hood includes a U-shaped support member and the shroud is attached to the collar section and the support member so that when the hood is deployed a portion of the support member and the shroud covers a person's head.

11. The personal flotation device of claim 9, wherein the collar section of the hood assembly includes a pair of integrated loops extending from a pair of loose ends of the collar section.

12. The personal flotation device of claim 11, wherein the loops of the hood assembly are fastenable to the pair of ends of the buoyant structure to hold the hood assembly in an erect position.

13. The personal flotation device of claim 1, wherein a tether line may be selectively used to attach a first flotation device to at least one other flotation device.

14. The personal flotation device of claim 1, wherein the flotational hood assembly includes a light source affixed to a hood support element of the hood assembly.

15. The personal flotation device of claim 10, wherein the U-shaped support member is an inflatable tube.

16. The personal flotation device of claim 15, wherein the inflatable tube is selectively inflated by blowing air into the inflatable tube through an oral inflation tube.

17. A personal flotation device, comprising:

a front section;

a rear section;

an intermediate section connecting the front section and the rear section;

a head-receiving opening formed in the intermediate section proximate an upper section;

a sleeve configured at the rear section and proximate a bottom section;

a buoyant structure having embedded looped webbing extending through the sleeve and having a pair of ends, wherein the buoyant structure comprises a pair of flotation tubes partially encased by a webbing having open ends exposing the pair of ends of the flotation tubes, the ends of each flotation tube having at least one integrated loop engageable with a fastener that is usable to secure the bottom portion of the flotation device to a person's mid-section;

a flotational hood assembly disposed about the head-receiving opening, the flotational hood assembly including a collar section extending around the head-receiving opening and attached to the rear section and the front section of the flotation device and having a pair of ends terminating at a point below a mid-portion off the head-receiving opening; and a fastener assembly configured to selectively releasably fasten the pair of ends of the buoyant structure.

18. A personal flotation device, comprising:

a front section;

a rear section;

an intermediate section connecting the front section and the rear section;

a head-receiving opening formed in the intermediate section proximate an upper section;

a sleeve configured at the rear section and proximate a bottom section;

a buoyant structure having embedded looped webbing extending through the sleeve and having a pair of ends, wherein the buoyant structure comprises a pair of flotation tubes partially encased by a webbing having open ends exposing the pair of ends of the flotation tubes, the ends of each flotation tube having at least one integrated loop engageable with a fastener that is usable to secure the bottom portion of the flotation device to a person's mid-section;

a flotational hood assembly disposed about the head-receiving opening, the flotational hood assembly including a collar section extending around the head-receiving opening and attached to the rear section and the front section of the flotation device and having a pair of ends terminating at a point below a mid-portion off the head-receiving opening; and a fastener assembly configured to selectively releasably fasten the pair of ends of the buoyant structure and the end of the collar section together, and wherein a tether line may be selectively used to attach a first flotation device to at least one other flotation device.

* * * * *